US005934518A

United States Patent [19]

Stern et al.

[11] Patent Number: 5,934,518

[45] **Date of Patent: *Aug. 10, 1999**

[54] AEROSOL TEXTURE ASSEMBLY AND METHOD

[75] Inventors: Donald J. Stern, Bellingham; James A. Tryon, Seattle, both of Wash.

[73] Assignee: Homax Products, Inc., Bellingham, Wash.

[ * ] Notice: This patent is subject to a terminal disclaimer.

[21] Appl. No.: 08/870,025

[22] Filed: Jun. 5, 1997

Related U.S. Application Data

[63] Continuation-in-part of application No. 08/451,732, May 26, 1995, Pat. No. 5,655,691, which is a continuation-in-part of application No. 08/321,559, Oct. 12, 1994, Pat. No. 5,524,798, which is a continuation-in-part of application No. 08/238,471, May 5, 1994, Pat. No. 5,409,148, which is a continuation of application No. 07/840,795, Feb. 24, 1992, Pat. No. 5,310,095, and a continuation of application No. 08/327,111, Oct. 21, 1994, abandoned, which is a continuation of application No. 08/216,155, Mar. 22, 1994, Pat. No. 5,450,983.

[51] Int. Cl.[6] ..... B65D 83/14

[52] U.S. Cl. ..... 222/402.1; 222/541.2; 239/391; 239/397

[58] Field of Search ..... 222/402.17, 402.1, 222/394, 564, 389, 386.5, 95, 105, 541.2, 541.6; 239/1, 337, 390, 391, 393, 394, 397

[56] References Cited

U.S. PATENT DOCUMENTS

| | | | |
|---|---|---|---|
| D. 25,916 | 8/1896 | Woods . | |
| Re. 30,093 | 9/1979 | Burger . | |
| D. 134,562 | 12/1942 | Murphy . | |
| D. 307,649 | 5/1990 | Henry . | |
| D. 358,989 | 6/1995 | Woods . | |
| 2,388,093 | 10/1945 | Smith . | |
| 2,686,652 | 8/1954 | Carlson et al. . | |
| 2,764,454 | 9/1956 | Edelstein . | |
| 2,785,926 | 3/1957 | Lataste . | |
| 2,790,680 | 4/1957 | Rosholt . | |
| 2,831,618 | 4/1958 | Soffer et al. . | |
| 2,839,225 | 6/1958 | Soffer et al. . | |
| 2,965,270 | 12/1960 | Soffer et al. . | |
| 3,083,872 | 4/1963 | Meshberg | 239/394 |
| 3,167,525 | 1/1965 | Thomas . | |
| 3,191,809 | 6/1965 | Schultz et al. . | |
| 3,196,819 | 7/1965 | Lechner et al. . | |
| 3,284,007 | 11/1966 | Clapp | 239/397 |

(List continued on next page.)

FOREIGN PATENT DOCUMENTS

| | | | |
|---|---|---|---|
| 770467 | 4/1967 | Canada | 222/564 |
| 1586067 | 2/1970 | France . | |
| 3806991 | 9/1989 | Germany . | |
| 867713 | 5/1961 | United Kingdom . | |
| 1144385 | 3/1969 | United Kingdom . | |

*Primary Examiner*—Philippe Derakshani
*Attorney, Agent, or Firm*—Michael R. Schacht; Hughes & Schacht, P.S.

[57] ABSTRACT

An aerosol assembly for applying texture material to a surface in a plurality of pre-existing texture patterns. One or more actuator assemblies are employed, each one defining an outlet orifice having a different cross-sectional area. Each actuator assembly is associated with or can be reconfigured to be associated with a different pre-existing texture pattern. In one form, the actuator assemblies comprise a plurality of identical button members having an outlet chamber and a tube member inserted into the outlet chamber of each button member. The tube members define discharge passageways having different cross-sectional areas. The entire actuator assembly is removed and replaced to dispense a different texture pattern. In another form, the actuator assemblies are individual button members manufactured to define outlet chambers that form discharge passageways of different cross-sectional areas. In a third form, the actuator assembly comprises an actuator button and a tube member that comprises a plurality of different sections each defining a discharge passageway portion having a different cross-sectional area.

14 Claims, 4 Drawing Sheets

U.S. PATENT DOCUMENTS 3,314,571 4/1967 Greenebaum .
3,342,382 9/1967 Huling .
3,346,195 10/1967 Groth .
3,377,028 4/1968 Bruggeman .
3,415,425 12/1968 Knight et al. .
3,422,391 1/1969 Krizka et al. .
3,450,314 6/1969 Gross .
3,467,283 9/1969 Kinnavy .
3,482,738 12/1969 Bartels .
3,503,882 3/1970 Fitch .
3,544,258 12/1970 Presant et al. .
3,548,564 12/1970 Bruce et al. .
3,592,359 7/1971 Marrafino .
3,596,835 8/1971 Smith et al. .
3,648,932 3/1972 Ewald et al. ..... 239/428.5
3,700,136 10/1972 Ruekberg .
3,704,831 12/1972 Clark .
3,788,521 1/1974 Laauwe .
3,806,005 4/1974 Prussin et al. .
3,814,326 6/1974 Bartlett .
3,819,119 6/1974 Coffey .
3,828,977 8/1974 Borchert .
3,862,705 1/1975 Beres et al. .
3,871,553 3/1975 Steinberg ..... 222/541.2
3,891,128 6/1975 Smrt .
3,913,842 10/1975 Singer .
3,938,708 2/1976 Burger .
3,982,698 9/1976 Anderson .
3,989,165 11/1976 Shaw et al. .
3,992,003 11/1976 Visceglia et al. .
4,032,064 6/1977 Giggard .
4,045,860 9/1977 Winckler .
4,089,443 5/1978 Zrinyi .
4,117,951 10/1978 Winckler .
4,148,416 4/1979 Gunn-Smith .
4,154,378 5/1979 Paoletti et al. .
4,171,757 10/1979 Diamond .
4,185,758 1/1980 Giggard .
4,187,959 2/1980 Pelton .
4,187,985 2/1980 Goth ..... 239/428.5
4,197,357 4/1980 Huisman .
4,198,365 4/1980 Pelton .
4,229,312 10/1980 Nagashiro et al. .
4,238,264 12/1980 Pelton .
4,293,353 10/1981 Pelton et al. .
4,308,973 1/1982 Irland .
4,322,020 3/1982 Stone .
4,346,743 8/1982 Miller .
4,358,388 11/1982 Daniel et al. .
4,370,930 2/1983 Strasser et al. .
4,401,271 8/1983 Hansen .
4,401,272 8/1983 Merton et al. .
4,412,929 11/1983 Lysenko et al. .
4,417,674 11/1983 Giuffredi .
4,442,959 4/1984 Del Bon et al. .
4,444,937 4/1984 Badertscher .
4,493,778 1/1985 Iqbal .
4,609,608 9/1986 Sole .
4,641,765 2/1987 Diamond .
4,818,781 4/1989 Yamakawa et al. .
4,854,482 8/1989 Bergner .
4,870,805 10/1989 Morane .
4,878,599 11/1989 Greenway ..... 222/541.2
4,896,832 1/1990 Howlett .
4,940,171 7/1990 Gilroy .
4,949,871 8/1990 Flanner .
4,969,577 11/1990 Werding .
5,007,556 4/1991 Lover .
5,028,497 7/1991 Somezawa et al. .
5,037,011 8/1991 Woods .
5,038,964 8/1991 Bouix .
5,059,187 10/1991 Sperry et al. .
5,100,055 3/1992 Rokitenetz .
5,115,944 5/1992 Nikolich .
5,126,086 6/1992 Stoffel .
5,188,263 2/1993 Woods .
5,211,317 5/1993 Diamond et al. .
5,307,964 5/1994 Toth .
5,310,095 5/1994 Stern et al. ..... 239/397
5,341,970 8/1994 Woods .
5,409,148 4/1995 Stern et al. ..... 222/402.1
5,421,519 6/1995 Woods .
5,450,983 9/1995 Stern et al. ..... 222/394
5,524,798 6/1996 Stern et al. ..... 239/393

AEROSOL TEXTURE ASSEMBLY AND METHOD

RELATED APPLICATIONS

This is a Continuation-In-Part of U.S. Ser. No. 08/451,732, filed May 26, 1995, now U.S. Pat. No. 5,155,691 which is a Continuation-In-Part of Ser. No. 08/321,559, filed Oct. 12, 1994, now U.S. Pat. No. 5,524,798, which is a Continuation-In-Part of Ser. No. 08/238,471, filed May 5, 1994, now U.S. Pat. No. 5,409,148, which is a Continuation of Ser. No. 07/840,795, filed Feb. 24, 1992, now U.S. Pat. No. 5,310,095, and a Continuation of Ser. No. 08/327,111 filed Oct. 21, 1994, abandoned, which is a Continuation of Ser. No. 08/216,155, filed Mar. 22, 1994, now U.S. Pat. No. 5,450,983.

TECHNICAL FIELD

The present invention relates to systems and methods for applying texture material to wall and ceiling surfaces and, more specifically, to such systems and methods that are implemented in aerosol form and allow texture material to be applied in a plurality of texture patterns.

BACKGROUND OF THE INVENTION

Texture material is often applied to flat surfaces such as walls and ceilings. The texture material creates a bumpy, irregular surface that is aesthetically pleasing and which helps to hide seams and the like formed by adjacent wall or ceiling panels. The textured surface is usually painted to obtain a desired finish color.

Texture material is a coating material that is sprayed on in liquid form and which dries to form the bumpy, irregular surface described above. The texture material may coat the entire surface or may be applied in discrete splotches on the surface.

When dry, the texture material forms a texture pattern. By varying one or more parameters such as the composition of the texture material and the manner in which the texture material is applied, different texture patterns may be formed. In the industry, the texture patterns are classified generally as follows: fine; orangepeel; medium splatter; heavy splatter; medium knockdown; and heavy knockdown. Of course, custom texture patterns may be formed, but the foregoing texture patterns are considered industry standards. One class of texture materials contains particulates and creates an acoustic or "popcorn" texture pattern that is normally applied to ceilings.

The fine, orangepeel, medium splatter, and heavy splatter texture patterns are obtained simply by spraying texture material onto the surface to be textured. The fine and orangepeel texture patterns are similar to each other, the orangepeel simply being a heavier application of texture material.

The medium and heavy knockdown texture patterns are formed by spraying the texture material onto the surface to be textured and, after a short wait but before the texture material dries completely, working the texture material with a tool to flatten or "knockdown" the peaks of the texture material. In general, the medium knockdown texture pattern is obtained by working the medium splatter texture pattern, and the heavy knockdown texture pattern is obtained by working the heavy splatter texture pattern.

In new construction, texture material is usually applied using a hopper gun connected to a compressor. The compressor supplies a stream of pressurized air that is mixed with texture material in the hopper gun; the stream of pressurized air carries the texture material out of the hopper gun and onto the surface to be textured. Examples of hopper gun type texturing systems are disclosed in U.S. Pat. No. 4,961,537 to Stern.

The texture pattern formed using this method may be varied by altering the air pressure, the manner in which the pressurized air and texture material are mixed, and/or the size of the opening through which the combined air and texture material is dispensed.

While the hopper gun technique is effective when large surface areas are to be textured, this technique is not very convenient when relatively smaller areas are to be textured. For example, if a portion of a drywall panel is patched, the patch will normally require a coating of texture material to ensure that the patched surface area matches the pre-existing texture pattern on the surrounding surface area. With often less than a square foot to be patched and textured, the set-up time of the equipment necessary to use the hopper gun will far exceed the time it takes to coat the patched surface.

A number of attempts have been made to create texturing systems and methods that simplify the process of texturing small areas.

U.S. Pat. Nos. 4,411,387, 4,955,545, 5,069,390, and 5,188,295 to Stern disclose the use of a hand-pump to generate the stream of pressurized air necessary to carry texture material out of the hopper gun. This process requires a fair amount of physical exertion for all but the smallest coverage areas.

U.S. Pat. Nos. 5,037,011 and 5,188,263 to Woods disclose the marketing of texture material in an aerosol container. Practically speaking, this system did not allow the creation of a plurality of different texture patterns.

U.S. Pat. Nos. 5,450,983 to Stern and 5,341,970 to Woods disclose aerosol devices for applying acoustic texture material to a surface.

U.S. Pat. Nos. 5,310,095, 5,409,148, 5,489,048, and 5,524,798 to Stern disclose systems that allow texture material to be dispensed from an aerosol container in a plurality of texture patterns. By changing a cross-sectional area of a discharge passageway through which texture material passes as it leaves the aerosol container, the texture pattern was varied to obtain a plurality of the standard texture patterns described above.

A number of methods of or systems for changing the effective cross-sectional area of the discharge passageway were disclosed in the Stern patents. One technique is to provide a plurality of straws each having the same outer diameter and each having a different inner diameter. Each straw corresponds to a different pre-existing texture pattern. One of these straws is selected and attached to the actuator button on the aerosol container such that the texture material passes through the straw as the material exits the container.

This technique allows the use of essentially off-the-shelf components but requires the manufacture of a plurality of different straws and that these straws be associated with the aerosol container throughout distribution, sales, and use of the product.

Another technique disclosed in the Stern patents is to provide an outlet member having a plurality of outlet orifices each having a different cross-sectional area and corresponding to a different pre-existing texture pattern. The outlet member is attached to the actuator button on the aerosol container but may be moved relative to the button; any one of the outlet orifices may be arranged such that texture material passes therethrough as the material exits the container.

This technique does not require that a number of separate components (straws) be sold with the aerosol container. But, in practice, this technique requires a custom actuator that is expensive to produce.

As briefly discussed above, texture material is sold in a number of formulations. These formulations can, however, be generally categorized either as water-based or oil-based. Hopper gun texturing systems generally employ water-based texture materials, while aerosol texturing systems contain both water-based and oil-based formulations.

With aerosol dispensing systems, oil-based texture materials are used to obtain fine or orangepeel texture patterns. Water-based formulations are unsuitable for obtaining fine and orangepeel texture patterns because water-based materials tend to form a stream as the texture material exits the container, plug easily, and tend to spit texture material inconsistently when the spray is started and stopped.

On the other hand, water-based texture materials are used to obtain knockdown texture patterns. Oil-based formulations are unsuitable for obtaining knockdown texture patterns because they dry too quickly and require solvent-based cleaners to clean up the tools used to work the texture material.

In summary, then, water-based texture materials have the following characteristics: easy clean up; easy removal if necessary; not malodorous; take longer to dry before it can be painted over; less durable. And oil-based texture materials have the following characteristics: quick drying; very durable; malodorous; require solvents for clean-up.

OBJECTS OF THE INVENTION

From the foregoing, it should be clear that one primary object of the present invention is to provide improved systems for and methods of applying texture material to surfaces such as walls and ceilings.

Another more specific object of the present invention is to provide improved texturing systems and methods having a favorable mix of the following characteristics:

reduced manufacturing costs;

simple to use; and reduced number of parts that must be manufactured and shipped.

SUMMARY OF THE INVENTION

These and other objects are obtained by the present invention, which is an aerosol device comprising a container assembly for containing texture material, a valve assembly mounted on the container assembly, and a plurality of actuator means each defining a discharge passageway. One of the actuator means is mounted on the valve assembly such that depressing the actuator means causes texture material to flow out of the container assembly through one of the discharge passageways.

The actuator means each comprise an actuator member defining an actuator chamber having an inlet opening and an outlet opening. The actuator chamber is further comprised of an inlet chamber and an outlet chamber. The inlet chamber has a cylindrical portion and a partially cylindrical portion. The outlet chamber intersects the inlet chamber at the partially cylindrical portion.

When the actuator means is depressed to cause the valve assembly to open, texture material flows into the inlet chamber through the inlet opening, into the outlet chamber, and out of the outlet chamber through the outlet opening.

The dimensions of the outlet chamber define the dimensions of the outlet opening. The dimensions of the outlet opening correspond to a given texture pattern. Each actuator means defines an outlet chamber having a different cross-sectional area; by selecting an appropriate one of the actuator means, texture material exiting the system is deposited on a surface in a desired texture pattern. The actuator means can be formed in a number of ways.

First, the actuator means may be a unitary member that would, preferably, be injection-molded. Three molds would be used to make three different members, each member having a discharge passageway of a different cross-sectional area. The tooling costs of this approach are high, but the costs of the parts are low, and the actuator means does not require any assembly costs after the part has been injection-molded.

Second, each actuator means may be an assembly of two parts: an actuator member and an outlet member. The actuator member defines an outlet chamber. Each of the outlet members is a hollow cylinder having an outer surface sized and dimensioned to be snugly received within the outlet chamber. The inner surface of the each of the outlet members defines a passageway of a different cross-sectional area. The outlet members are simply cut from a longer cylindrical straw. An actuator means of this design could use a conventional actuator member and thus would not require significant tooling costs, but does require some assembly.

Third, each actuator means may be an assembly of an actuator member and an outlet member in which the outlet member has an outer surface that is contoured to conform to an outer surface of the actuator member. The outlet member would be cut from a longer cylinder and machined or injection molded to the appropriate shape. This actuator means could also use a conventional actuator member but requires assembly.

Fourth, each actuator means may be an assembly of an actuator member and an elongate, multi-section outlet member. The outlet member comprises a plurality of sections each defining a passageway having a different internal diameter. The outlet member may be used in one piece with the smallest cross-sectional area passageway downstream; or, the outlet member may be broken into two or more pieces, each one of which may be inserted into the actuator member. Annular notches may be formed in the outer surface of the outlet member to facilitate the breaking of this member into two or more pieces. Also, one or more annular projections may be formed on the outer surface of the outlet member to ensure that the individual pieces are properly mated with the actuator member.

DETAILED DESCRIPTION

Figure 1:
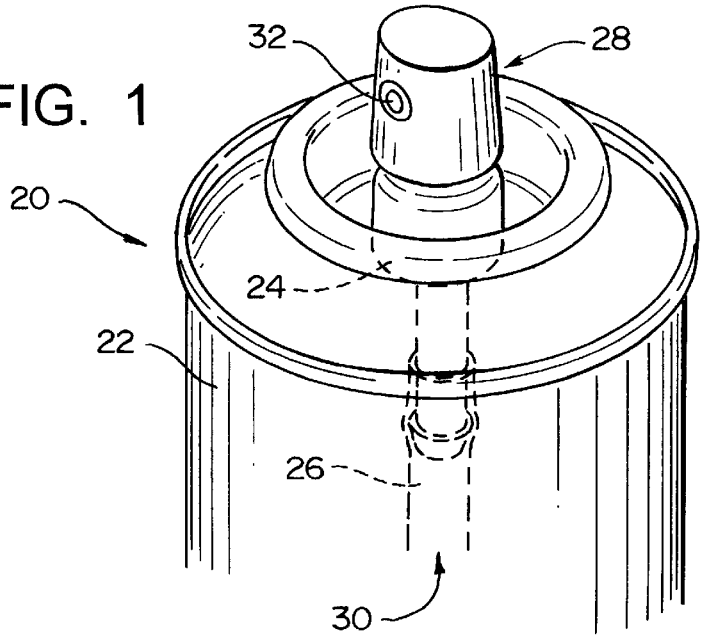
FIG. 1 is a partial perspective view of an aerosol dispenser constructed in accordance with, and embodying, the principles of the present invention.

Referring initially to FIG. 1, depicted therein is an aerosol system 20 constructed in accordance with, and embodying, the principles of the present invention. This aerosol system 20 comprises a container portion 22, a valve assembly 24, a dip tube 26, and a plurality of actuator assemblies 28. The aerosol container 22, valve assembly 24, and dip tube 26 are all conventional and well understood in the art and will be discussed herein only to the extent necessary for a full understanding of the present invention.

The container 22 contains texture material to be dispensed and a propellant material. The propellant material has at least a portion that forms a gaseous phase which collects at the top of the container 22 when the container 22 is in its upright position. The propellant material forces the texture material to the bottom of the container 22.

The dip tube 26 creates a dispensing path 30 from the bottom of the container 22 to a discharge passageway 32 defined by the actuator assembly 28. The valve assembly 24 is mounted on the container portion 22 and is operable between open and closed configurations.

The actuator assemblies 28 are spring-biased by the valve assembly 24 into an upper position in which the valve assembly 24 is in its closed configuration. When the valve assembly 24 is in its closed configuration, fluid cannot exit the container 22 through the dispensing path 30. When the actuator assembly 28 is depressed towards the valve assembly 24 into a lower position, a stem portion 34 (FIGS. 2–4) of the actuator assembly 28 engages the valve assembly 24 and places the valve assembly 24 into its open configuration. With the valve assembly 24 in the open configuration, pressurized texture material (as well as some propellant material) flows out of the container 22 through the dispensing path 30 and the discharge passageway 32.

The texture material within the container 22 comprises a base or carrier component, a binder component, and a filler component. The base or carrier component is usually a water or oil that, when the texture material is not exposed to the ambient air, keeps the texture material in a liquid state. When the texture material is exposed to ambient air, the base or carrier component evaporates, allowing the texture material to harden.

When the base or carrier component evaporates, the binder component and filler component remain to form a coating. The filler is usually one or more relatively inexpensive materials that give body to the final coating and/or impart a desired color to this coating.

The texture material is either water-based or oil-based and may contain other components such as biocides and/or rust inhibitors.

The propellant material can be one or more of a number of such materials as long as it is compatible with the chosen texture material. At least a portion of the propellant is in a gaseous state in which it pressurizes the texture material. The propellant material can be one of a number of liquid hydrocarbons that will gassify to maintain the appropriate pressure within the container. The propellant material may also be an inert gas such as oxygen or nitrogen that will not have a liquid phase in the system 20.

Figure 2:
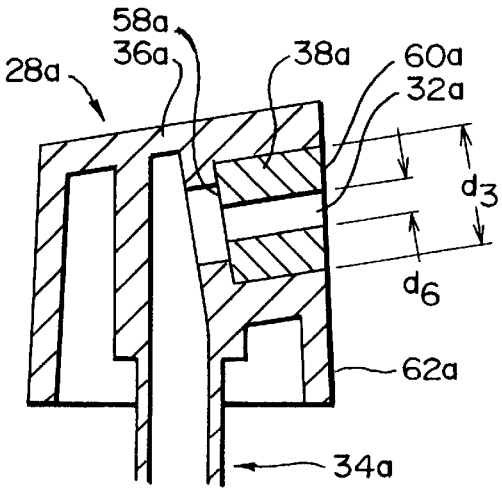
FIGS. 2–4 are side cut-away views of actuator assemblies employed by the aerosol device depicted in FIG. 1.
Figure 3:
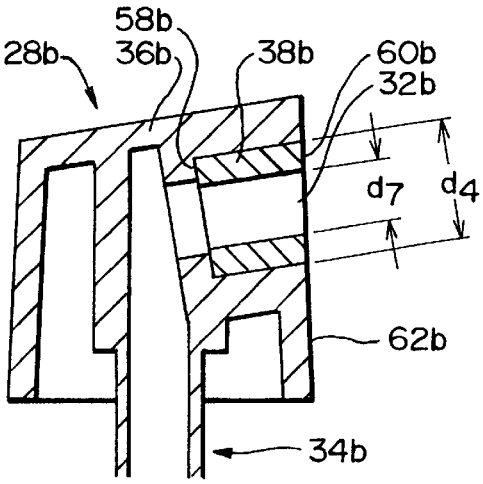
Figure 4:
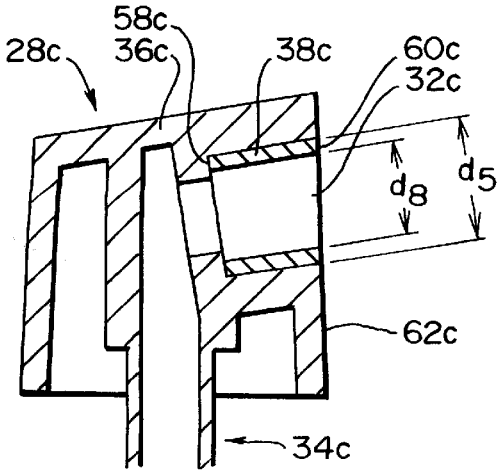

FIGS. 2–4 depict first, second, and third actuator assemblies 28*a,* 28*b,* and 28*c* that are used as the actuator assembly 28 of the aerosol device 20. These actuator assemblies 28*a–c* are constructed in the same manner but have one significant difference: the cross-sectional areas of the discharge passageways 32*a,* 32*b,* and 32*c* defined by these assemblies 28*a–c* are different. These discharge passageways 32*a–c* are circular or ovoid in shape, but other shapes may be used to obtain a similar effect.

FIGS. 2–4 illustrate that the actuator assemblies 28*a–c* are, in the exemplary aerosol system 20, two-part assemblies including an actuator button 36 and a tube member 38.

Figure 5:
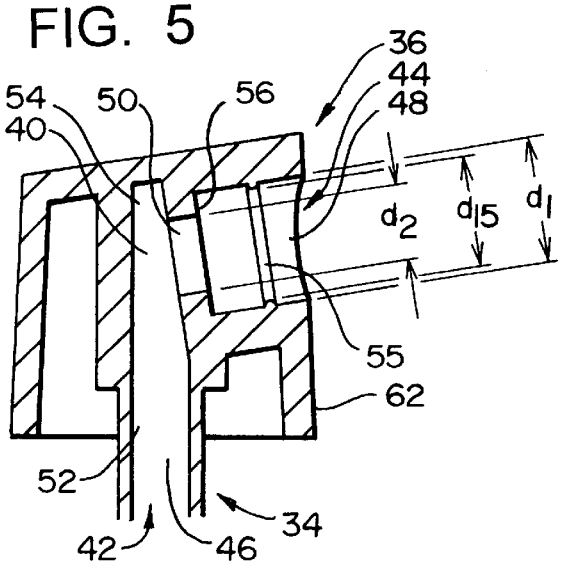
FIG. 5 is a side cut-away view of an actuator button of the actuator assemblies used in FIGS. 2–4.

Referring for a moment to FIG. 5, the actuator button 36 is depicted therein apart from the assemblies 28. Actuator buttons such as the button 36 are widely available in the marketplace. These actuator buttons 36 are mass produced using injection molding techniques.

More specifically, in addition to the stem portion 34 briefly described above, the actuator button 36 defines an actuator chamber 40. The actuator chamber 40 has an inlet opening 42 and an outlet opening 44. The actuator chamber 40 further comprises an inlet portion 46, outlet portion 48, and intermediate portion 50. The inlet portion 46 itself has a cylindrical portion 52 and a partially cylindrical portion 54. The outlet chamber 48 and intermediate chamber 50 are cylindrical in cross section, are typically coaxially aligned, and intersect the partially cylindrical portion 54 of the input chamber 46 at an angle. A diameter d1 of the outlet chamber 48 is larger than a diameter d2 of the intermediate chamber such that a shoulder 56 is formed at an innermost end of the outlet chamber 48.

The actuator button 36 is designed to accommodate straws having an outer diameter substantially equal to the diameter d1 of the outlet chamber 48. An annular projection 55 (diameter $d_{15}$) is formed on the button 36 such that the projection 55 extends into the outlet chamber 48 and forms a press or interference fit that helps to lock the straw to the actuator member.

As briefly mentioned above, the exemplary actuator button 36 is mass produced using injection molding techniques, but other techniques may be used.

Referring now back to FIGS. 2–4, it can be seen that the tube members 38*a–c* have outer diameters d3, d4, and d5 and inner diameters d6, d7, and d8, respectively. The outer diameters d3–d5 are substantially the same as the diameter d1 of the outlet chamber 48 (FIG. 5) of the actuator button 36; this allows the tubes 38*a–c* to be snugly received within the outlet chamber 48 of the actuator buttons 36*a–c*. The lengths of these tube members 38*a–c* are all the same and approximately equal to the length of the outlet chambers 48.

The inner diameters d6–8 are all different, with the diameter d8 being greater than the diameter d7 and the diameter d7 being greater than the diameter d6 in the exemplary system 20. The inner diameters d6–d8 define the cross-sectional areas of the discharge passageways 32*a–*32*c*, respectively.

One of the actuator assemblies 28*a–c* is mounted onto the valve assembly 24. So mounted, the dispensing path 30 extends through the actuator chamber 40 and also through the discharge passageways 32*a–*32*c*. And each of the inner diameters d6–d8 is associated with a different predetermined texture pattern.

Accordingly, the user will initially determine which of the predetermined texture patterns is desired, select one of the actuator assemblies 28*a–c* as appropriate to match that desired predetermined texture pattern, and mount the selected actuator assembly 28 onto the valve assembly 24.

The selected actuator assembly 28 is then depressed to place the valve assembly 24 into its open configuration, thereby allowing the gaseous phase portion of the propellant material to force the texture material along the dispensing path through the dip tube 26, valve assembly 24, actuator assembly 28, and out of the outlet opening 32.

The exemplary aerosol system 20 described above thus comprises the container 22, the valve assembly 24, the dip tube 26, and first, second, and third actuator assemblies 28*a–c*. When actually sold as a commercial product, this system 20 may further comprise a cap adapted to engage the container 22 and cover the end thereof on which the valve assembly 24 is mounted. The first, second, and third actuator assemblies 28*a–c* may be contained underneath this cap or otherwise attached to the container 22.

The system 20 will be sold in connection with instructions indicating which of the predetermined texture patterns is associated with each of the actuator assemblies 28*a–c*. In this respect, color coding at least the tube members 38*a–c* of these assemblies 28*a–c* will facilitate the correlation between actuator assembly and predetermined texture pattern.

Once the appropriate actuator assembly 28 has been selected, it is mounted onto the valve assembly 24 by inserting its valve stem 34 into an opening at the top of the valve assembly 24. The container 22 is then arranged such that the outlet orifice 32 is directed towards a surface to be textured, and the actuator assembly 28 is depressed to dispense texture material onto the surface as described.

Subsequently, if the same system 20 is to be used to apply texture material to a different surface having a different texture pattern formed thereon, the appropriate one of the actuator assemblies 28*a–c* is selected to match the texture on the second surface. If the actuator assembly 28 that matches the texture on the second pattern is different from the one employed to apply texture to the first surface, the original actuator assembly 28 is removed and another one attached to the valve assembly 24 as required to match the texture on the second surface.

In this way, the aerosol system 20 described herein can be reconfigured by selecting an appropriate one of the actuator assemblies 28*a–c*, removing a non-selected assembly if necessary, and mounting the selected actuator assembly onto the valve assembly 24.

An important benefit of the present invention as embodied in the exemplary aerosol system 20 is that it can be simply manufactured and sold using readily available parts. In particular, as mentioned above, the container 22, valve assembly 24, and dip tube 26 all are, or may be, off-the-shelf items.

The actuator button 36 is also commercially available at a very low price. The tube members 38*a–c* can easily be made from elongate tubes that are molded or extruded. Extruded tubes in particular are very inexpensive and can easily be manufactured in large quantities at a low price. Such tubes would originally be purchased in cylindrical shape and cut into the shape shown in FIGS. 2–4.

More specifically, a cylindrical length of tube may be cut into a plurality of tube members 38, with each tube member having an inner, annular end surface 58 and an outer surface 60. The inner surface 58*a* may be, as shown in FIG. 2, orthogonal to a longitudinal axis of the tube member 38*a*. The outer surface 60*a* of the exemplary tube member 38*a* conforms to a frustoconical outer surface 62*a* of the actuator button 36*a*.

Alternatively, the tube portion 38*a* may be injection molded to the exact shape shown in FIG. 2. This would require tooling for the injection molding process, but would obviate the need to cut or otherwise machine the tube member 38*a* from a larger piece of stock material.

In any event, the tube member 38*a* is inserted into the outlet chamber 48. Friction alone may, in some situations, be sufficient to maintain the tube member 38*a* within the chamber 48. When the tube member 38*a* is fully inserted into the chamber 48, the rear wall 58*a* will engage the annular shoulder 56 at the end of the chamber 48. An adhesive may be applied to one or both of the actuator button 36 and the tube member 38 to help ensure that the tube member 38 will not move relative to the actuator button 36.

Figure 6:
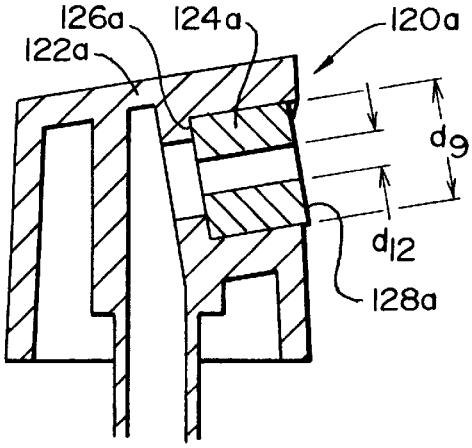
FIGS. 6–8 depict side cut-away views of actuator assemblies of a second embodiment of the present invention.
Figure 7:
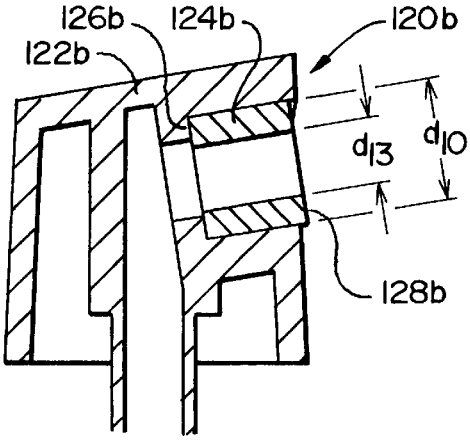
Figure 8:
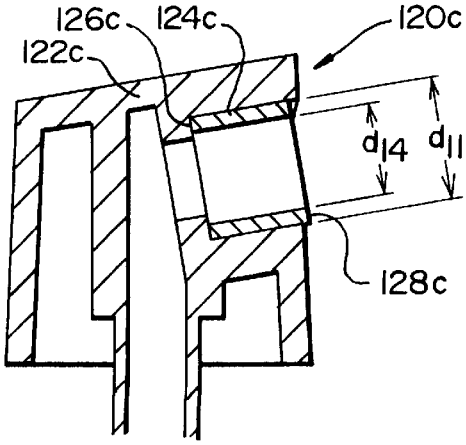

Referring now to FIGS. 6–8, depicted therein are first, second, and third actuator assemblies 120*a*, 120*b*, and 120*c*. These actuator assemblies 120*a–c* may be substituted for the actuator assemblies 28 in the system 20.

The actuator assemblies 120*a–c* comprise an actuator button 122 and a tube member 124. The actuator buttons 122*a–c* are identical to the buttons 36 described above and will not be discussed again. The tube members 124*a–c* are similar to the tube members 38*a–c* described above in that they have an outer diameter d9, d10, d11, and an inner diameter d12, d13, d14, respectively. The tube members 124*a–c* further comprise an inner end wall 126 and an outer wall 128. The inner end walls 126*a–c* are the same as the inner end walls 58*a–c* described above, but the outer end walls 128*a–c* are different from the outer end walls 60*a–c* described above.

In particular, the outer end walls 128*a–c* are substantially parallel to the inner end walls 126*a–c* and perpendicular to the longitudinal axis of the tube members 124*a–c*. The tube members 124*a–c* need only be cut along a plane and not machined, molded, or otherwise manufactured to conform to the outer surface of the actuator button.

In all other respects the actuator assemblies 120*a–c* are used in the same manner as the actuator assemblies 28*a–c*.

Figure 9:
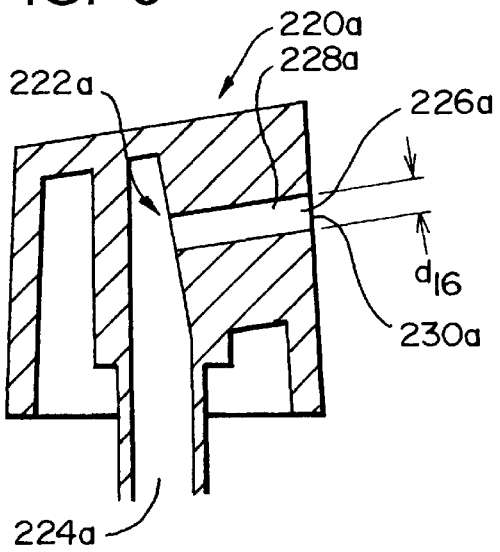
FIGS. 9–11 depict actuator buttons of a third embodiment to the present invention.
Figure 10:
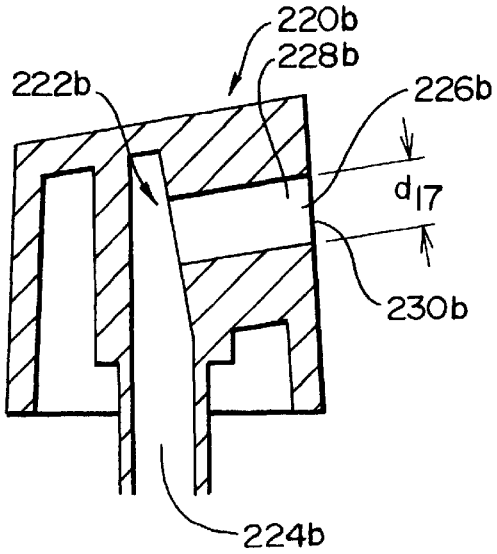
Figure 11:
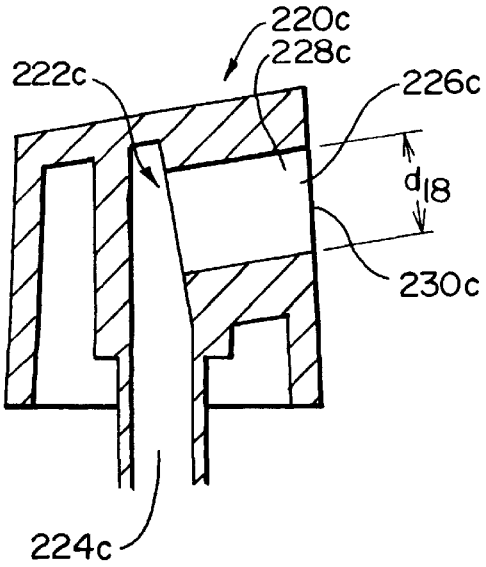

Referring now to FIGS. 9–11, depicted therein are first, second, and third actuator members 220*a*, 220*b*, and 220*c* of a third embodiment of the present invention. These actuator members 220*a–c* are used in substantially the same manner as the actuator assemblies 28 and 120 described above. Again, these actuator members 220 would be substituted for the actuator assemblies 28 in the aerosol system 20 shown in FIG. 1.

FIGS. 9, 10, and 11 show that the actuator members 220*a*, 220*b*, and 220*c* are all a single part. This part is preferably injection-molded, although other manufacturing techniques may be used. These members 220*a–c* are similar to the actuator button 36 described above but differ in several important respects. The actuator members 220*a–c* do not have an intermediate chamber such as the intermediate chamber 50 of the actuator button 36. Instead, the actuator members 220*a–c* each define an actuator chamber 222*a–c* comprising only an inlet chamber 224*a–c* and an outlet chamber 226*a–c*. The outlet chambers 226*a–c* are defined by cylindrical inner walls 228*a–c*. Each of these outlet chambers 226 defines an outlet orifice 230*a–c* that functions in the same manner as the outlet orifices 32 described above. More specifically, the outlet chambers 226*a–c* each has a different diameter d16, d17, and d18, respectively.

Each of the actuator members 220*a–c* is injection molded with the inner walls 228*a–c* integrally formed therewith. In situations where very large quantities of the actuator members 220*a–c* are to be made, injection molding these members on a large scale may be practical.

Figure 12:
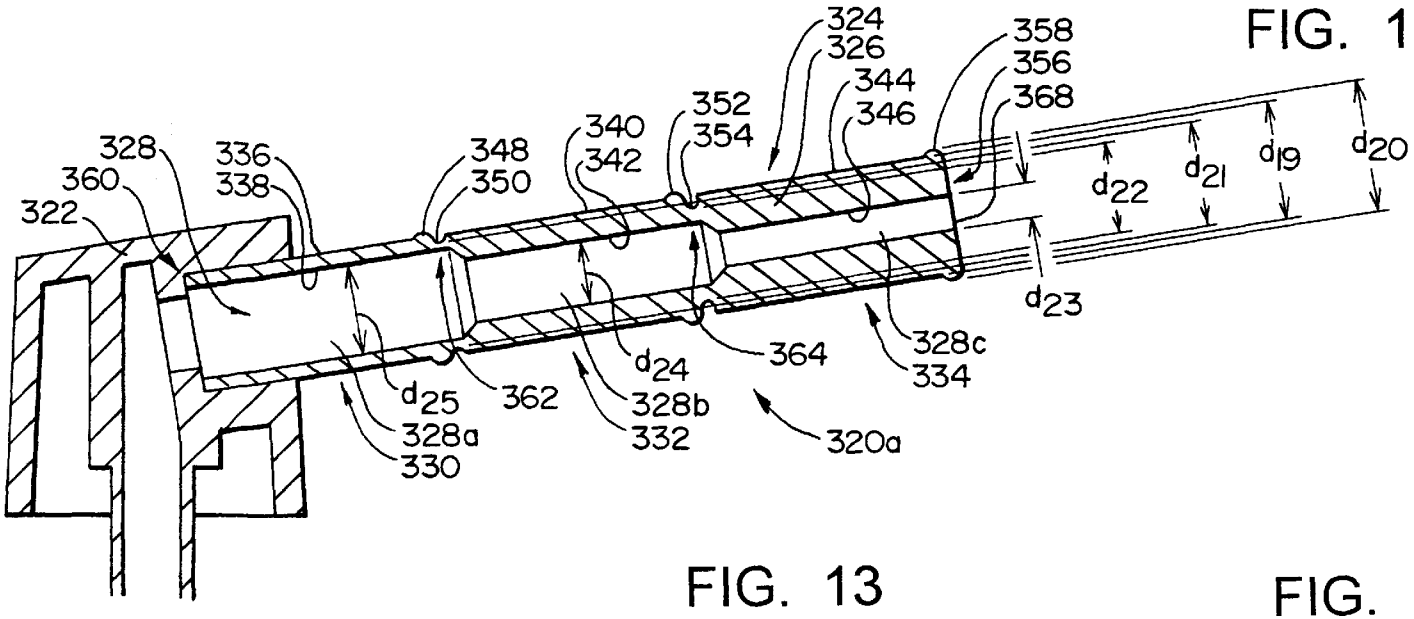
FIG. 12 depicts a side cut-away view of an outlet tube that may be used in an unbroken configuration to dispense a first predetermined texture pattern.
Figure 13:
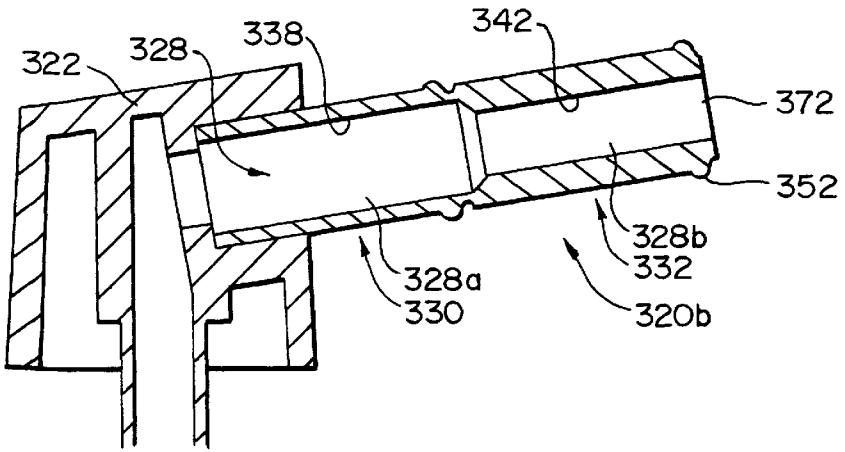
FIG. 13 is a view similar to FIG. 12 in which the outlet tube has been broken to dispense texture material in a second predetermined texture pattern.
Figure 14:
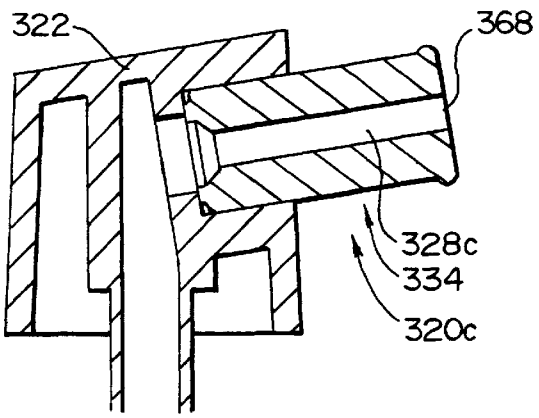
FIG. 14 is a side cut-away view of the outlet tube depicted in FIG. 12 used in another way to obtain the first predetermined texture pattern.

Referring now to FIGS. 12–14, depicted therein is yet another exemplary actuator assembly 320 constructed in accordance with, and embodying, the principles of the present invention. The actuator assembly 320 comprises an actuator button 322 and a discharge tube 324. This actuator assembly 320 is used in place of the actuator assemblies 28 in the system 20 described above.

The discharge button 322 is identical to the discharge button 36 described above and will not be described in further detail.

The discharge tube 324 comprises a generally cylindrical body portion 326 which defines a centrally extending discharge passageway 328. When the assembly 320 is mounted onto the container 22, the discharge passageway 328 defines a portion of the dispensing path 30 of the system 20.

The discharge tube body portion 326 comprises first, second, and third functional portions 330, 332, and 334. The first tube portion 330 comprises an outer surface 336 and an inner surface 338. The second tube portion 332 comprises an outer surface 340 and an inner surface 342. The third tube portion 334 comprises an outer surface 344 and an inner surface 346. The inner surfaces 338, 342, and 346 define discharge passageway portions 328*a*, 328*b*, and 328*c*.

Formed on the outer surface 336 of the first tube portion 330 adjacent to the second tube portion 332 is an annular projection 348 and an annular groove 350. Formed on the outer surface 340 of the second tube portion 332 is a projection 352 and a groove 354. Formed on the outer surface 344 of the third tube portion 334 adjacent to a distal end 356 of the tube 324 is a projection 358.

Except for the projections 348, 352, and 358 and grooves 350 and 354, the outer surfaces 336, 340, and 344 all have a diameter d19. The diameter of these outer surfaces 336, 340, and 344 at the projections 348, 352, and 358 is a diameter d20. Associated with the groove 350 in the first tube portion 330 is a diameter d21 while associated with the groove 354 in the second tube portion 332 is a diameter d22.

The diameter d19 is substantially the same as the diameter d1 of the actuator button 322, while the diameter d20 is slightly greater than the diameter d1. This allows only a proximal end 360 of the tube member 324 to be inserted into the outlet cavity of the actuator member 322, with the projection 358 preventing the distal end 356 from being inserted into the actuator button discharge cavity.

The diameter d21 of the groove 350 and diameter d22 of the groove 354 create reduced thickness portions 362 and 364, respectively, of the tube body 326. The purpose of these reduced thickness portions 362 and 364 will become apparent from the following discussion.

FIG. 12 also shows that the inner wall 346 of the third tube portion 334 has a diameter d23, the inner wall 342 of the second tube portion 332 has a diameter d24, and the inner wall 338 of the first tube portion 330 has a diameter d25. As is apparent from the drawing, the diameter d25 is greater than the diameter d24, and the diameter d24 is greater than the diameter d23.

These inner wall surfaces 338, 342, and 346 define the discharge passageway portions 328*a*, 328*b*, and 328*c*, respectively, and thus provide each of these passageway portions with a different cross-sectional area. Therefore, each of the tube portions 330, 332, and 334 is associated with a predetermined texture pattern.

As with the embodiments described above, the user first determines which of three predetermined or pre-existing texture patterns most closely matches a desired texture pattern. For example, the desired texture pattern may be the pattern of an existing textured wall surface that requires repair.

If the desired texture pattern most closely matches the predetermined texture pattern associated with the third tube portion 334, normally a fine or orangepeel texture pattern, the proximal end 360 of the tube member 324 will be engaged with the actuator button 322, and the actuator assembly 320 will be used as shown in FIG. 12. Texture material exiting the exit passageway 328 will last pass through the discharge passageway portion 328*c* associated with the third tube portion 334. With the discharge tube 324 configured as shown in FIG. 12, the inner wall 346 defines an outlet orifice 368 through which texture material is dispensed. The cross-sectional area of this orifice 368 is defined by the diameter d23 described above.

If the desired texture pattern most closely resembles the predetermined texture pattern associated with the second tube portion 332, the third tube portion 334 is simply removed as shown by a comparison of FIGS. 12 and 13. In this case, texture material will last pass through the discharge passageway portion 328*b* defined by the inner wall 342 of the second tube portion 332. With the third tube portion 334 removed, a new outlet orifice 372 is defined; the cross sectional diameter of this outlet orifice 372 is defined by the diameter d24 described above.

If the desired texture pattern most closely corresponds to the predetermined texture pattern associated with the first tube portion 330, the second tube portion is removed from the first tube portion such that an exit orifice of the actuator assembly 320 is defined by a cross-sectional area of the discharge passageway portion 328*a* defined by the inner wall 338 of the first tube portion 330.

As described above, the tube member 324 may be used as one piece or separated into two or three separate pieces. As described above, the reduced diameter portions formed by the grooves 350 and 354 allow the tube member 324 to be broken by hand at the correct locations. If the tube member 324 is made of an appropriate plastic material, the reduced diameter portion 364 of the tube body 326 allows the third tube portion 334 to be snapped off cleanly.

With other materials or if the grooves 350 and 354 are omitted, the tube member 324 may be cut with a tool into its various sections. In this case, the outer surfaces 336, 340, and 344 should be marked at the appropriate locations to identify where the member 324 should be cut.

Subsequently, if the user has already broken off the third tube portion 334 and wishes to dispense texture material in the predetermined pattern associated with that third tube portion 334, the third tube portion 334 may be directly connected to the actuator button 322. Texture material exiting the actuator assembly 320 will thus pass through the exit orifice 368 and be deposited on a surface in the predetermined texture pattern associated with the third tube portion 334.

It should be noted that the projections 348, 352, and 358 prevent the tube member from being inserted in the wrong orientation relative to the actuator button 322. Generally speaking, the smallest diameter discharge passageway portion should be arranged downstream.

The projections 348, 352, and 358 and grooves 350 and 354 need not be provided, or only the projections or only the grooves may be provided. If either or both of these features is eliminated, the discharge tube 324 may be cut into the various portions 330, 332, and 334 and care may need to be taken to ensure that a small diameter portion is not placed upstream of a large diameter portion. And as described above, if none of these surface features is provided, marks must be made to indicate where one of the sections 330, 332, and 334 ends and another begins.

The tube body 326 described above may be easily manufactured using injection molding techniques. This embodiment to the present invention has the advantage of requiring that only one additional member be manufactured and shipped with the entire system 20 rather than multiple members as is the case with the systems described above with reference to FIGS. 2–11 or with the prior art method of including a plurality of straws.

The following Table A sets forth the dimensions of certain of the parameters described above for the preferred embodiments of the present application as well as certain ranges in which these parameters should be kept to practice the present invention.

TABLE A

| Parameter | Preferred Embodiment | First Preferred Range |
|---|---|---|
| $d_1$, $d_3$, $d_4$, $d_5$, $d_9$, $d_{10}$, $d_{11}$, $d_{19}$ | 0.175 | 0.165–0.195 |
| $d_6$, $d_{12}$, $d_{16}$, $d_{23}$ | 0.075 | 0.040–0.080 |
| $d_7$, $d_{13}$, $d_{17}$, $d_{24}$ | 0.095 | 0.085–0.110 |
| $d_8$, $d_{14}$, $d_{18}$, $d_{25}$ | 0.145 | 0.115–0.165 |
| $d_{15}$ | 0.170 | 0.160–0.190 |
| $d_{20}$ | 0.180 | 0.170–0.200 |
| $d_{21}$ | 0.170 | 0.160–0.190 |
| $d_{22}$ | 0.165 | 0.155–0.185 |

It is to be recognized that various modifications can be made without departing from the basic teaching of the present invention. The scope of the invention should thus be determined by the claims appended hereto and not the foregoing detailed description.

We claim:

1. A system for applying texture material to a surface in a texture pattern matching one of a plurality of pre-existing texture patterns, comprising:

container means for containing the texture material and a propellant material, whereby the propellant material pressurizes the texture material;

valve means mounted on the container means for selectively opening or blocking a dispensing path that extends from the interior of the container means to the exterior thereof, whereby pressurized texture material flows out of the container means through the dispensing path when the valve means opens the dispensing path;

a plurality of actuator assemblies each associated with one of the pre-existing texture patterns, where each actuator assembly comprises an actuator button having a stem portion adapted to engage and operate the valve means, wherein the actuator button defines an outlet chamber through which part of the dispensing path extends, and a tube member having an outer cross-sectional area and an inner cross-sectional area, in which the outer cross-sectional area is sized and dimensioned to be received within the outlet chamber and the inner cross-sectional area forms a part of the dispensing path through which the texture material exits the system and corresponds to one of the pre-existing texture patterns.

2. A system as recited in claim 1, in which the tube member is substantially contained within the outlet chamber.

3. A system as recited in claim 1, in which the tube member is entirely contained within the outlet chamber.

4. A system as recited in claim 1, in which the actuator member comprises an actuator outer surface and the tube member comprises a tube outer surface, where the tube outer surface substantially conforms to the actuator outer surface when the tube member is received within the outlet chamber.

5. A system as recited in claim 4, in which the first outer surface is frustoconical.

6. A system as recited in claim 1, in which the tube member comprises an outer surface, where the outer surface of the tube member is substantially perpendicular to a longitudinal axis of the tube member.

7. A system as recited in claim 1, in which:

the actuator member has an intermediate chamber that is adjacent to the outlet chamber;

a shoulder is formed on the actuator member adjacent to the intermediate chamber and the outlet chamber; and the tube member has an inner surface that abuts the shoulder when the tube member is received within the outlet chamber.

8. A system as recited in claim 7, in which the tube member comprises an outer surface, where the outer surface of the tube member is substantially parallel to the inner surface of the tube member.

9. A system for applying texture material to a surface in a texture pattern matching one of a plurality of pre-existing texture patterns, comprising:

container means for containing the texture material and a propellant material, whereby the propellant material pressurizes the texture material;

valve means mounted on the container means for selectively opening or blocking a dispensing path that extends from the interior of the container means to the exterior thereof, whereby pressurized texture material flows out of the container means through the dispensing path when the valve means opens the dispensing path; and a plurality of actuator members each associated with one of the pre-existing texture patterns, where each actuator member defines an inlet chamber and an outlet chamber that define a portion of the dispensing path and each outlet chamber has a different cross-sectional area.

10. A system for applying texture material to a surface in a texture pattern matching one of a plurality of pre-existing texture patterns, comprising:

container means for containing the texture material and a propellant material, whereby the propellant material pressurizes the texture material;

valve means mounted on the container means for selectively opening or blocking a dispensing path that extends from the interior of the container means to the exterior thereof, whereby pressurized texture material flows out of the container means through the dispensing path when the valve means opens the dispensing path;

an actuator button having a stem portion that engages the valve means and defining an outlet chamber forming a part of the dispensing path; and a discharge tube having a plurality of tube portions, where each tube portion defines an inner surface; wherein at least one of the tube portions is mounted onto the actuator member such that at least one of the inner surfaces defined by the tube portions defines a portion of the discharge path;

the inner surfaces defined by the tube portions each define a cross-sectional area that is associated with one of the pre-existing texture patterns; and the cross-sectional area associated with each of the tube portions is different.

11. A system as recited in claim 10, in which the tube member comprises an outer surface having a cross-sectional area that is substantially the same for each of the plurality of tube portions.

12. A system as recited in claim 10, in which a reduced thickness wall portion is formed in the tube member at the junctures of adjacent tube portions to facilitate reconfiguration of the tube member into at least two separate tube portions.

13. A system as recited in claim 10, in which an increased thickness wall portion is formed adjacent to a first end of the tube member to inhibit placement of the first end of the tube member into the outlet chamber.

14. A system as recited in claim 13, in which the tube portion comprises at least first and second tube portions, wherein:

the cross-sectional area associated with the second tube portion is smaller than the cross-sectional area associated with the first tube portion; and the first tube portion is adjacent to the first end of the tube member and the second tube portion is spaced from the first end of the tube member.

* * * * *